US011393437B2

(12) United States Patent
Nauer et al.

(10) Patent No.: US 11,393,437 B2
(45) Date of Patent: Jul. 19, 2022

(54) ARRANGEMENT AND METHOD FOR THE CONVERSION OF AT LEAST ONE DETECTED FORCE FROM THE MOVEMENT OF A SENSING UNIT INTO AN AUDITORY SIGNAL

(71) Applicant: MICTIC AG, Zurich (CH)

(72) Inventors: Roger Nauer, Wangen (CH); Thomas Rupp, Hombrechtikon (CH); Rolf Hellat, Zurich (CH); Markus Schaub, Zurich (CH)

(73) Assignee: MICTIC AG, Zürich (CH)

( * ) Notice: Subject to any disclaimer, the term of this patent is extended or adjusted under 35 U.S.C. 154(b) by 0 days.

(21) Appl. No.: 16/473,521

(22) PCT Filed: Dec. 22, 2017

(86) PCT No.: PCT/EP2017/084490
§ 371 (c)(1),
(2) Date: Jun. 25, 2019

(87) PCT Pub. No.: WO2018/115488
PCT Pub. Date: Jun. 28, 2018

(65) Prior Publication Data

US 2019/0355335 A1 Nov. 21, 2019

(30) Foreign Application Priority Data

Dec. 25, 2016 (CH) ..... 01742/16

(51) Int. Cl.
*G10H 1/00* (2006.01)

(52) U.S. Cl.
CPC ..... *G10H 1/0066* (2013.01); *G10H 1/0008* (2013.01); *G10H 2220/201* (2013.01);
(Continued)

(58) Field of Classification Search
CPC ..... G10H 1/0066; G10H 1/0008; G10H 2220/395; G10H 2240/321;
(Continued)

(56) References Cited

U.S. PATENT DOCUMENTS 4,980,519 A * 12/1990 Mathews ..... G10H 1/00 178/19.01
5,192,826 A * 3/1993 Aoki ..... G10H 1/053 84/626
(Continued)

FOREIGN PATENT DOCUMENTS

EP 1 583 073 A1 10/2005
JP H08-314455 A 11/1996
(Continued)

OTHER PUBLICATIONS

URL:https://blog.highfidelity.com/how-much-latency-can-livemusicians-tolerate-da8e2ebe587a, "How much latency can live musicians tolerate?" May 2, 2013, retrieved Feb. 23, 2018, (4 pages).
(Continued)

*Primary Examiner* — Jeffrey Donels
(74) *Attorney, Agent, or Firm* — Pauley Erickson & Swanson

(57) ABSTRACT

An arrangement for the conversion of at least one detected force from the movement of a sensing unit into an auditory signal. The arrangement includes at least one sensor for generating a force signal from the at least one detected force. A processing unit is configured for converting the force signal into a digital auditory signal. An output unit for converting the digital auditory signal into an auditory signal is further included wherein the digital auditory signal includes in formation of acceleration, strength and duration of a single detected force. The present method is used for converting at least one detected force affecting an object into
(Continued)

auditory signal, as well as the use of an arrangement according to the present invention for various entertainment and/or therapeutic purposes.

20 Claims, 1 Drawing Sheet

(52) U.S. Cl.
CPC . *G10H 2220/395* (2013.01); *G10H 2240/211* (2013.01); *G10H 2240/285* (2013.01); *G10H 2240/311* (2013.01); *G10H 2240/321* (2013.01)

(58) Field of Classification Search
CPC ..... G10H 2220/201; G10H 2240/311; G10H 2240/285; G10H 2240/211
See application file for complete search history.

(56) References Cited

U.S. PATENT DOCUMENTS

| | | | | |
|---|---|---|---|---|
| 5,541,358 | A | 7/1996 | Wheaton et al. | |
| 6,388,183 | B1 * | 5/2002 | Leh | G10H 1/0008 84/645 |
| 6,897,779 | B2 * | 5/2005 | Nishitani | G10H 1/0083 340/384.3 |
| 7,781,666 | B2 * | 8/2010 | Nishitani | G10H 1/00 84/723 |
| 7,807,913 | B2 * | 10/2010 | Choi | H04M 1/72442 84/600 |
| 7,939,742 | B2 * | 5/2011 | Glaser | G10H 1/0555 84/615 |
| 8,743,076 | B1 * | 6/2014 | Ludwig | G06F 3/017 345/173 |
| 9,799,315 | B2 * | 10/2017 | Hardi | G10D 13/26 |
| 9,812,029 | B1 * | 11/2017 | Henry | G10G 7/00 |
| 10,152,958 | B1 * | 12/2018 | Sheely | G10H 1/0008 |
| 10,643,593 | B1 * | 5/2020 | Kolen | G10H 1/0025 |
| 2002/0026866 | A1 | 3/2002 | Nishitani et al. | |
| 2002/0166438 | A1 | 11/2002 | Nishitani et al. | |
| 2004/0011189 | A1 | 1/2004 | Ishida et al. | |
| 2008/0250914 | A1 | 10/2008 | Reinhart et al. | |
| 2010/0132536 | A1 | 6/2010 | O'Dwyer | |
| 2012/0297961 | A1 | 11/2012 | Shim | |
| 2017/0344113 | A1 * | 11/2017 | Grierson | G06F 3/03547 |
| 2020/0202825 | A1 * | 6/2020 | Kolen | G06K 9/00355 |

FOREIGN PATENT DOCUMENTS

| | | | |
|---|---|---|---|
| JP | H09-97070 | A | 4/1997 |
| JP | 2001-195059 | A | 7/2001 |
| JP | 2004-53930 | A | 2/2004 |

OTHER PUBLICATIONS

European Patent Office, English language version of the International Search Report, Form PCT/ISA/210 for Int'l Appln PCT/EP2017/084490, dated Mar. 23, 2018 (4 pages).

European Patent Office, English language version of the Written Opinion of the International Searching Authority, Form PCT/ISA/237 for Int'l Appln PCT/EP2017/084490, dated Mar. 23, 2018 (7 pages).

https://www.soundonsound.com/cound-advise/q-how-much-latency-acceptable-cirtual-piano#, Anonymous: "How much latency is acceptable for virtual piano?" Sound On Sound, Sound Advice, Published On-line, Oct. 2013 (3 pages).

https://www.gearslutz.com/board/music-computers/594810-acceptable-latency.html, "'Acceptable' latency," Gearslutz.com, The Forums—Music Computers, comments by various, Published On-Line Mar. 24-25, 2011 (11 pages).

EPO, Communication pursuant to Article 94(3) EPC (EPO Form 2001 & EPO Form 2906) for EP 17 835 683.8, dated May 4, 2020, Munich, Germany (9 pages total).

JPO, "Notice of Reasons for Rejection," for corresponding Japanese Patent Application No. 2019-530193, dated May 25, 2021 (8 pages) together with the English Language Translation (7 pages).

* cited by examiner

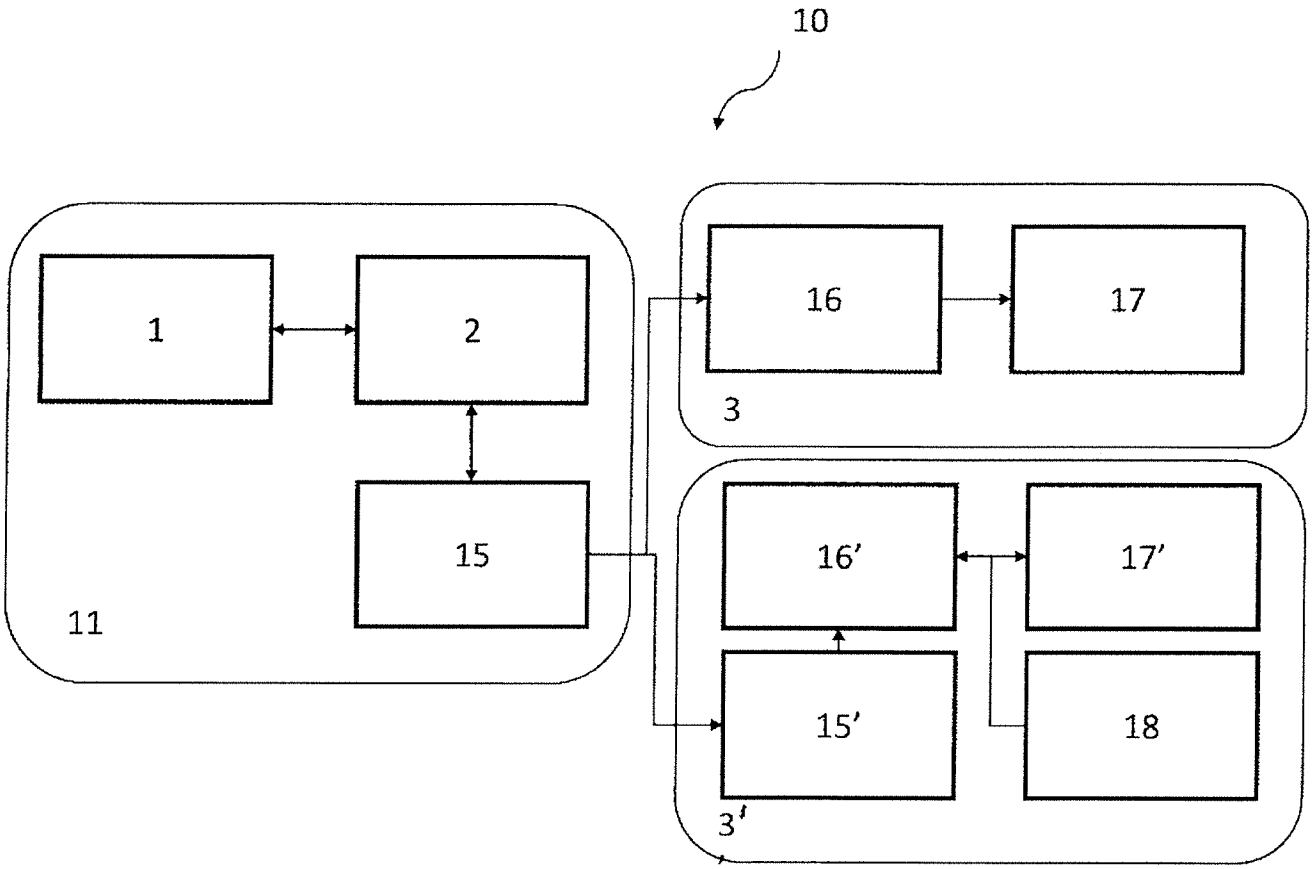
10
16
17
3
16'
17'
18
15'
3'
1
2
15
11

ARRANGEMENT AND METHOD FOR THE CONVERSION OF AT LEAST ONE DETECTED FORCE FROM THE MOVEMENT OF A SENSING UNIT INTO AN AUDITORY SIGNAL

BACKGROUND OF THE INVENTION

Field of the Invention

The present invention relates to the conversion of a detectable force, in particular a force resulting from the movement of an object, into an auditory signal, preferably for entertainment purposes. The invention further in particular relates to an arrangement for the conversion of at least one detected force into an auditory signal, the use of a motion sensor for the same and a respective method for converting at least one detected force affecting an object into an auditory signal.

Discussion of Related Art

Devices that are able to convert a detected force resulting from the movement of a person into a digital signal are known from the entertainment industry. Gaming consoles nowadays come equipped with one type or another of a controller that is capable of converting a spatial movement of the said controller into a digital signal that is processed by the console. These controllers implement gesture recognition and motion sensitivity to interact with an electronic device.

Most often, the controller keeps a wireless connection with a base station, such as a gaming console by means of which information gathered from said movement detection is transmitted.

One major issue though with all these devices is that latency above a certain threshold impairs the immersion into the gaming environment.

One further application in the field of electronic entertainment devices is the conversion of detectable force signals into audio signals. US 2012/02 97961 A1 discloses a keytar controller with percussion pads and accelerometer. The keytar comprises a piano style keyboard with a number of keys on the front face and a neck extending from one side. Further a number of drum pads are arranged on the front face of the keyboard body. The keytar further comprises a microprocessor, which is arranged to scan the state of each of the drum pads and generate a Musical instrument digital interface ("MIDI") note signal corresponding to the state of the drum pads. The device further comprises an accelerometer which provides to the microprocessor information relating to the tilt of the keytar. This information is converted into a MIDI continuous controller value, which is outputted from the keytar to control an external synthesizer or computer. All these functions are implemented in the said keytar to provide a more versatile instrument.

US 2010/0132536 A1 on the other hand discloses a file creation process and a respective apparatus for increased audio interaction that aims at making music interaction such as mixing more intuitive and accessible for the average person. As a further object, the invention is aimed at altering the music playback from being a oneway, static environment like television broadcast into an interactive, dynamic and collaborative entertainment experience. For this end, an audio wave form song is combined with a MIDI time grid. This invention further comprises as a particular aspect a so called "interactive collaboration device".

This can take the form of a smartphone, such as an iPhone, by means of using the smart phone's accelerometer with the retro file format to achieve a new form of sound. Particular examples that are suggested by this document are the use of the three axis of accelerometer of an iPhone by assigning to each axis of movement of a particular audio signal which then can be triggered by the respective movement of the smart phone in that axis. This is still dependent from a retro fit song being processed in the background.

There is therefore a need for devices for use in the field electronic entertainment that enable a conversion of detectable force resulting from a movement of the said device into an auditory signal. Such a device should preferably enable an immersive acoustic experience and create a vivid sound experience, that is as closely related to the triggering movement as possible and preferably along a definable and predetermined sound pattern on the discretion of the user.

It is therefore an aim of the present to provide an arrangement for the conversion of at least one detected force resulting from the movement of a device into an auditory signal that overcomes at least one disadvantage of the state of the art. In particular, it is an object of the present invention to provide such an arrangement, method and use of a respective sensor that is effective and provides an increased immersion for the user. It is a particular and further object of the present invention, to provide such a device that is reliable and low cost in manufacture.

Such an arrangement, method and use of a sensor is provided according to the subject claims.

SUMMARY OF THE INVENTION

One aspect of the present invention is an arrangement for the conversion of at least one detected force from the movement of a sensing unit into an auditory signal. The arrangement comprises at least one sensor for generating the force signal form the at least one detected force. The at least one sensor is preferably comprised in the sensing unit. The arrangement further comprises a processing unit, which is configured for converting the force signal into a digital auditory signal.

The processing unit is also preferably comprised in the sensing unit. The arrangement further comprises an output unit for converting the digital auditory signal into an auditory signal.

The output unit can be also comprised in the sensing unit, but can alternatively be separate from the sensing unit in the form of a separate item.

The output unit can, in a particular embodiment, be part of a computer system, such as a notebook, a desktop computer, a smartphone and/or a tablet with respective means of outputting an auditory signal. In its basic form, the output unit is a smartphone with loud speakers and the respective interfaces to convert the digital auditory signal into an auditory signal. In this arrangement according to the present invention, the digital auditory signal comprises information on acceleration, strength and duration of a single detected force.

In the sense of the present invention, a suitable at least one sensor capable of detecting a force resulting from movement can be, in its most basic implementation, an accelerometer. Preferably, the accelerometer should be capable of measuring at least the acceleration the object the accelerometer is affixed to undergoes. The accelerometer has an inertial mass whose displacement is measured as an indication of the acceleration the accelerometer undergoes, and transformed into a digital signal by means of a piezo electric, piezo resistive and/or capacitive element for converting the detected mechanical motion into an electric signal.

In the context of the present invention, the digital auditory signal does not require to contain audio data. In a most preferred embodiment, the digital auditory signal is a steering signal for controlling an audio signal generation element, even more preferred the digital auditory signal is a MIDI signal.

In a preferred embodiment, the accelerometer is adapted to measure at least acceleration in three axis.

In a particular embodiment, the digital auditory signal is an 8 bit signal.

In a particular embodiment, the arrangement is adapted to apply a machine learning algorithm to recognize a pre-learned movement sequence and convert it into a digital auditory signal, more particularly, the processor is adapted to apply said machine learning algorithm. For instance, the processor can be adapted to recognize a movement sequence of the arrangement by analyzing the force signals and match that movement sequence to a pre-learned movement sequence. In this particular example, the pre-learned movement sequence can consist of a plurality of parameters that where generated based on a statistically relevant number of reference movements that were detected by a similar force sensor. These parameters are embedded in the arrangement and machine learning algorithms used to match detected force signals and resulting movement sequences with the pre-learned ones. Upon matching, the processor is adapted to generate a specific digital auditory signal, reflective of said movement sequence.

In a particular embodiment the arrangement comprises a first casing where in the at least one sensor and processing unit is housed and a second casing wherein the output unit is housed. This arrangement comprises further a data exchange unit, for transferring said digital auditory signal between processing unit and output unit, while preferably the data exchange unit being adapted at wirelessly transferring said digital auditory signal between processing unit and output unit. In a particular embodiment, said data exchange unit is adapted at wirelessly transferring said digital auditory signal between processing unit and output unit. In a further particular embodiment, the arrangement comprises a port for transferring said digital auditory signal between processing unit and output unit. In a particularly preferred embodiment, the wirelessly transferring of the digital auditory signal between processing unit and output unit is based on a Bluetooth communication protocol.

In an alternative embodiment, the sensor unit comprises at least one sensor and a processing unit as well as the output unit are arranged in a unitary casing, where all of the components of the arrangement according to the present invention are arranged. In this embodiment, the means for transferring said digital auditory signal between processing unit and output unit can be a simple connection between the two units, such a physical connection and/or can comprises a wireless communication means as described above.

In a particular embodiment, the output unit is a smartphone. It has surprisingly been found that by using an 8 bit signal as digital auditory signal the latency between the force effect on the sensor and the actual output of the auditory signal is reduced to a level, where immersion for the user and audio feedback resulting from the movement of the sensor provides the best possible emersion. Preferably, the latency between force sensing and output of an audio signal based on a digital auditory signal generated by the detection of the said force signal is maximally 30 ms.

It has further been found, that by using an 8 bit signal as an auditory digital signal, a wider bandwidth of comparable output units can be used in conjunction with the arrangement of the present invention. These output units can be configured to provide a range of auditory signals according to the wishes of the user.

In a particular embodiment said first casing and said second casing are arranged to be detachably combinable with each other. Preferably either or both of the casing come equipped with an element that provides means for attaching it to other casing. Examples for such means can be form fit, snap fit, magnets and/or hook and pile fasteners.

In this particular embodiment, either one or both casings can come equipped with the respective positive or negative fit structures that enable the user to combine both casings in a manner that holds them together or to attach any one of the two casings to a further object. It has been found to be particularly preferable, if the first casing is attachable to an object which is subject to a movement for instance. In a particular embodiment the first casing can come equipped with a strap or a lash, such that it is attachable to a person, preferably a limp extension and provides force signals resulting from the movement of said limp extension.

In a particular embodiment, the first casing is equipped with means that make it detachably attachable to a moving device, such as sporting device. Sporting devices selected from the group consisting of: bikes, hockey sticks, golf sticks, baseball gloves and bats, football keeper gloves, running shoes, fencing weapons, skis, snowboards, sporting guns, Ping-Pong or tennis rackets, etc. have all been found to provide a particularly enjoyable source of force signals that can be converted into digital auditory signals and ultimately into auditory signals by means of an arrangement according to the present invention.

In a particular embodiment, the arrangement comprises one or more energy source, in particular one or more rechargeable energy source. The arrangement can come equipped with one or more USB or micro USB chargeable energy sources on either one, both or any number of casings that make up an arrangement according to the present invention and anyone of the previously described embodiments. Suitable energy sources can be chosen by the skilled artisan from lithium ion batteries available for the micro device and smartphone market.

In a particular embodiment, the arrangement comprises at least one communication system, preferably a bus system and respective connections. In even more preferred embodiment, the arrangement comprises at least one USB system.

In a particular embodiment, the processing unit is arranged to convert the force signal into a digital auditory signal by attributing a first digital information to a force signal dimension, a second digital information to a second force signal dimension, a third digital information to a third force signal dimension, and in particular, by attributing a first digital information to an acceleration, a second digital information to an intensity and a third digital information to a duration of a single detected force. In this particular embodiment, the digital auditory signal can comprise an 8 bit signal, such as a MIDI signal composed of the three values above. In a potential application of the present invention a progression of such signals can be converted into a respective progression of auditory signals such that a sound is created that is reminiscent of the original movement which was detected by the sensor. This auditory signal can be chosen in tone, rhythm and modulation according to the wishes of the person using it by choosing from a predetermined set of sound packages which each comprise a particular algorithm on how to convert digital auditory signals into an auditory signal. Most commonly these digital auditory signals take the form of MIDI processable signals.

In a particular embodiment the output unit further comprises an audio output and/or an audio output connector. An audio output can for instance in a loud speaker and/or amplifier. One particular suitable example of audio output connector can be audio jack socket.

In a particular embodiment, the arrangement comprises a storage medium, in particular for storing digital auditory signals. The storage unit can be adapted to store a sequence of digital auditory signals as detected by the sensor and converted by the processing unit into a digital auditory signal or it can come equipped with a series of auditory signals attributable to a digital auditory signal which can be output if a particular digital auditory signal has been produced by the processor. Suitable storage mediums can be also of the removable type, such as memory cards and flash memory cards that fit into respective slots on either one element of the arrangement. In a particular example, such a removable storage medium can be filled with auditory signals of a particular predetermined choosing that are then output when the respective digital auditory signal is detected, such that and overlaying mood or sound type can be played according to a detected movement. The other way around is also thinkable, though or can be used in combination with this previously described embodiment. In this mode of operation, a series of digital auditory signals is recorded on to the memory card according to a sequence of movement detected by the sensor. This recording can then be transferred to another device or to an output unit and made to be output in the form of auditory signals.

In another particular embodiment, the storage medium is adapted to store pre-learned movement sequences in the form of parameters. During operation, the processor matches a movement sequence and uses the stored pre-learned movement sequence to convert it into a digital auditory signal. This can be further improved, by utilizing machine learning algorithms for matching movement sequences of a user to pre-learned movement sequences. By utilizing pre-learned movement sequences and machine learning algorithms, latency in the conversion of the force signal into the digital Auditory signal can be reduced even further.

In a particular embodiment, the parameters are constructed from movement vectors detected by the sensor capable of detecting a force. In practice, for example, the sensors can comprise an accelerometer and a magnetometer, each supplying for a particular movement up to three input vectors, one for each axis of movement. These vectors are the used to define a set of parameters based on a large set of such measurements and applying a neural network for calculating them.

The parameters are then used as fixed constants embedded in the executable software of the arrangement and thereby accelerating the recognition of movement sequences and generating digital auditory signals out of them.

In a particular embodiment, the arrangement can comprise a plurality of storage medium including, but not excluded to storage buffers required for the operation of the processing unit and interoperability of the various electronic components of the arrangement.

In a particular embodiment, a storage buffer can be used to time a plurality of simultaneous digital auditory signals to be output in the form of auditory signals in sequence. This mode of operation enables to translate very complex movements with changing acceleration in all three recordable axes into a respective sound composition.

In a particular embodiment, the processing unit is configured for converting a sequence of consecutively sensed force signals into a sequence of digital auditory signals according to a defined algorithm. The algorithm can be adapted, for instance, to provide a particular force signal with the output of a predetermined first tone. If the consecutively detected force signal is a movement to right, for example, the algorithm starting from the first tone provides that second detected movement with a second tone. If the movement, by contrast is to the left, the algorithm provides it with a different second tone reflective of that movement to the left. With such an algorithm the different types of movements and the respective direction can result into a sound pattern that make the type of movement recognizable. In a particular embodiment, the algorithm is adapted to provide the same logic to a certain type of movement in a reproducible manner. In this embodiment, an essentially identical movement results in an essentially identical auditory signal. Alternatively, the algorithm can be programmed to provide a random pattern according to a defined random number generation. In this embodiment, two identical or essentially identical movements provide different auditory signals.

In a particular embodiment, the force sensor is adapted to sense acceleration at least three accesses. In a particular embodiment, the arrangement comprises an accelerometer that is adapted at sensing static and/or dynamic forces of acceleration, such as gravity, vibrations and movement.

In a particular embodiment, the arrangement comprises a plurality of sensors, for generating a force signal from a plurality of detected forces, each and simultaneously. The processor can then be configured to fuse the plurality of force signals into one digital auditory signal. Such a sensor can for instance be an inertial sensor comprising gyroscope, accelerometer and magneto meter, each collecting data from a single movement. This single movement is then translated by the arrangement according to the present invention into an auditory signal based on data from all these sensors working in conjunction with each other.

In a particular embodiment, the processor generates a string of digital auditory signals out of force signals processed per time interval. Most movements can be divided into a series of individual accelerations in a particular time interval. Such consecutive time intervals can be registered by the arrangement to follow a specific interval set routine and therefore result in an auditory signal that reflects the series of acceleration and the respective time intervals they took place. In other words, a series of movements in a particular time interval can be processed into a rhythm that is output based on the auditory digital signals processed.

In a particular embodiment, the at least one sensor is a sensor adapted at detecting a force effecting the arrangement, wherein the force is a movement and/or an impact effecting the arrangement. Preferably, the at least one sensor is a sensor selected from the group consisting of: gyroscope, accelerometer and/or magnetometer. Particularly suitable is a sensor comprising all the above sensor elements.

In an embodiment of the present invention, the processing unit is configured for converting the force signal into a digital auditory signal on the basis of a determined conversion protocol. This conversion protocol can, for instance, be configured to attribute a particular MIDI sound to a particular type of movement.

In a preferred embodiment, the determined conversion protocol is a preselected conversion protocol out of a series of conversion protocols. A storage medium can, for example, store a series of determined conversion protocols based on a type of sound such as jazz, rock'n'roll, hip-hop and appropriate auditory signals are produce based on that choice.

In a particular embodiment, the processor is adapted to categorize the force signal and converts said force signal into a digital auditory signal based on a determined conversion protocol based on said categorization. For example, an abrupt deceleration of the arrangement can be detected as an impact of the arrangement with a solid object and make the arrangement choose a digital auditory signal that reflects such an impact, like for example a gong or drum beat.

In a particular embodiment, the processor is adapted at converting the force signal into a digital auditory signal with a latency between 5 and 35 ms, in particular between 10 and 20 ms and even more particularly lower than 20 ms. Particularly preferred is a total latency between force signal detection and auditory signal output of no more than 30 ms.

In a particular embodiment, the arrangement comprises a further microphone. This microphone can be adjusted to record ambient sound onto a storage medium, while simultaneously movement detected by the arrangement is also recorded on the storage medium. This is particularly useful for applications, where the arrangement is used as an augmented reality enabler. For example: the sound of a tennis match can be recorded and further enhanced by specific auditory signals based on the detection of certain force signals deriving from movement. Sensor units according to the present invention can be attached to the net, the rackets of the players, their shoes, even specific areas of the ground and provide a digital auditory signal that translate into an auditory signal enhancing the natural sound of the match.

In a particular embodiment, the microphone is configured, such as to provide live transmission of sound it records from the output unit simultaneously with auditory signals derived from digital auditory signals that are based on movement detected by the sensor unit. With such a tool a movement action can be monitored and experienced over a distance, when the arrangement comprises an output unit that is detachable from the sensor unit and is placed in a different location.

In a particular example, boxing gloves can be equipped with sensor units. The output units would output the sound directly recorded at the gloves simultaneously with the enhancement provided by the sensor unit which registers movement force and transforms it into a digital auditory signal that is readable by the output unit and can be used to enhance the experience of the live sound from the microphone.

With an arrangement according to the present invention a device in the field of electronic entertainment is provided that is versatile in its modes of employ and provides an enhanced degree of emersion with a movement activity.

In a particular embodiment, the present invention can be used to provide sound in an ambience that is normally devoid of sound or where sound is the only way of monitoring a particular movement.

One aspect of the present invention is the use of an arrangement as previously described in a white cane to provide auditory signals reflective of the movement of the white cane to a person. In this embodiment, the sensing unit can be installed in or near the tip of the white cane, while the output unit can be placed discreetly inside the ear. A Bluetooth connection between the two units transmits digital auditory signals from the sensing unit to the ear microphone and provides further information on vibrations, resistance and motion of the white cane. With this, white canes for visually impaired persons can be made to provide much more accurate and additional information, thereby helping the visually impaired person in navigating the environment. In a particular embodiment, a further microphone detects and processes ambient sound or provides respective filters, such as to increase the auditory perception means of the person operating the white cane.

One aspect of the present invention is a method of converting at least one detected force affecting an object into an auditory signal. Preferably, said auditory signal is somehow reflective on the nature and type of the said force that triggered it. This method comprises the step of providing an arrangement for a conversion at least one detected force into auditory signal.

Preferably, an arrangement as described above is provided.

The method comprises further the step of affixing at least one sensor for generating a force from the at least one detected force and a processing unit configured for converting the force signal into a digital auditory signal on to said object. Both, the sensor and the processing unit are integral parts of that arrangement.

The method of present invention further comprises the step of sensing a force affecting the object with a sensor and converting the said force signal into a digital auditory signal. Preferably said digital auditory signal is a MIDI signal and in an even more preferred embodiment, the latency with which that happens is below a threshold of 30 milliseconds.

The method according to the present invention further comprises the step of converting the digital auditory signal into an auditory signal by means of an output unit.

In a particular embodiment, an algorithm is provided that attributes each force signal to a particular digital auditory signal.

One aspect of the present invention is a computer program product comprising computer executable instructions for performing the method described above. In a particular embodiment, the computer program product is embedded in an arrangement according to the present invention.

One further aspect of the present invention is the use of motion sensor adapted at generating a force signal from at least one detected force for generating a force signal in an arrangement adapted at converting said force signal into a digital auditory signal that can be converted into auditory signal by an output device. Preferably, said sensor comprises one or more force detection sensor selected from the group consisting of: gyroscopes, accelerometer, magneto meters, compasses, inertial sensors, absolute orientation sensor and/or electromagnetic sensors.

One aspect of the present invention is use of an arrangement as initially described, in particular an arrangement for the conversion of at least one detected force from the movement of a sensing unit into auditory signal, said arrangement comprising at least one sensor, a processing unit, an output unit and characterized in that digital auditory signal comprises information on acceleration, strength and duration of a single detected force and the said arrangement is capable of converting at least one detected force into auditory signal with the latency below 30 milliseconds, preferably below 20 milliseconds.

In the context of the present invention an augmented reality can defined as natural occurring sound that accompanies a particular movement that is enriched by sounds created by the arrangement according to the present invention, but which are originated and processed on the basis on the movement detected by said arrangement. This auditory augmented reality can be used in conjunction with a visual augmented reality that is provided for instance by a smartphone or a virtual reality headset.

In a particular embodiment, the arrangement is attached to an object whose movement should be reflected in the auditory signal.

One further aspect of the present invention is the use of an arrangement as described above for complementing movement performed with sporting devices with auditory signals. An arrangement as described above is provided with means for fastening the arrangement in particular the sensing unit of such arrangement to a sporting device, such as a hockey stick, baseball bat, Ping-Pong racket, fencing weapon, etc. Alternatively, the use according to the present invention for complementing sporting devices can be also realized by providing such sporting devices with a sensing unit as described above relating to the arrangement. In this embodiment, the sensing units at least one sensor is adapted at detecting a movement of said sporting device.

One further aspect of the present invention is the use of an arrangement as described above for movement coaching. For this purpose, movement is sensed as previously described by means of the sensing unit and respective auditory signals or output by the output unit. The processing unit can be arranged said certain boundaries to movement, which cause the conversion of a movement into digital auditory signal that results into a particular sound pattern which gives the user feedback on whether his movement was performed within the said boundaries. With this application, the coordination of movement processes supported with an auditive feedback which can be follow live and for each position of the movement. In a particular example, the processing unit can be adapted to omit the conversion of the force signal into a digital auditory signal for a movement transpires within a certain threshold. If that threshold is surpassed, which means either the movement is too fast or not within a certain range of motion, processing unit generates a digital auditory signal out of the force sensed which than results into a sound in the form of a n auditory signal that provides the user feedback on the exact time point and face of the movement where he left the boundaries such defined.

In a particular embodiment of this aspect, a certain movement pattern is recognized by the processing unit as descend by the force sensor. The processing unit generates a series of digital auditory signals, that correspond to an auditory signal that his harmonious. If the movement diverges from said movement pattern a descant tone is produced as an auditory signal thus providing feedback to the user that the ideal movement pattern has been left.

In a particular embodiment of this aspect, a plurality of sensing units are adapted to measure a plurality of objects, each one individually for example, whether the movement of said objects follows a specific pattern. One possible application is to have a real-time review of the synchronicity of a plurality of movements. This application is particularly interesting for dancing.

In a particular embodiment of this aspect, the processing unit is adapted to process a plurality of force signals each originating from a separate force sensor and analyze, whether the plurality of force signals follow a specific predefined relation towards each other. In an alternative embodiment to this aspect, the processing unit adapted to analyze the force signals from a plurality of sensing units and generating a plurality of digital auditory signals out of the individual sensing.

One further aspect of the present invention is the use of an arrangement as previously described in connection with a video camera capable of recording visual images. In a particularly preferred embodiment of this use, the video camera is a so-called action camcorder that is capable of registering and filming a movement while said movement is been perform ed. In this embodiment, the arrangement of the present invention is adapted to coordinate the conversion of a force signal from a movement into a digital auditory signal simultaneously while the movement is being performed and recorded by the action camera. The processor is thus adapted to link movement with specific sound patterns.

With this use it is possible, to couple a recorded film from a movement directly with an audio track resulting from the auditory signals produced by the arrangement according to the present invention in conjunction with the movement of the device. The result combination product is a video with an individual sound track reflective of the movement of the video recorded.

In a particular embodiment, the soundtrack thus produced is generated on the basis of a set of digital auditory signals that is predetermined and can be chosen by the user. For instance, it is possible to choose from a hard rock, jazz or hip-hop predetermined sound track and the processor thus generates digital auditory signals reflective of the chosen music style based on the movement the sensing unit detected.

In a particular embodiment of the present invention, particular movement patterns are attributed to particular sound effects and generated dynamically as they are being detected by sensing unit. Intensity such as speed or strength of impact of a movement can be also be reflected by the volume, pitch or bass intensity of the output unit according to measurement of the sensing unit.

In a particular embodiment of the present use, the arrangement is adapted to be removably attachable to an action camera, such that all movement said camera performs is recorded by the sensing unit and can be output in real time by the output unit.

In a particular embodiment of this use, the arrangement according to the present invention is adapted to register the movement simultaneously with the video file registration such that it can be directly processed and uploaded, played back or stored for future use. This application enables to creation of sound track enhanced video clips form an action movement that do not require further video processing skills or a manual addition of a sound track.

In a particular embodiment of this use, the processor can be adapted to further convert sounds that are recorded by a microphone to the arrangement into either digital auditory signals as the movements are or for recording purposes companioning the sound track generated by the movement.

In a particular preferred embodiment, live sounds adjusted by a microphone are enhanced with digital auditory signals resulting from the movement of the object the arrangement is attached to.

This use is particularly interesting in combination with all the fields where action cameras are used, such as biking, downhill, skiing, paragliding, running, swimming, kiting and so forth. In a particular embodiment of this use the choice of predetermined sounds track realizable by digital auditory signals created from the processor is adapted to a specific type of sport. It is conceivable, that the arrangement comes adapted for a particular type of sport or already implemented into the respective sporting tool.

In a particular embodiment of this use the arrangement comprises further earphones, that are either in Bluetooth connection with the output unit or connected by means of a cable and audio jack such that the user can experience the output of the output unit real time and live.

One further aspect of the present invention is the use of arrangement as previously described for wellness purposes. The arrangement can be used with relaxing movements such as yoga or Thai-chi and provide a corresponding meditative auditory signal track that enhances the relaxation and meditative depth of said movement.

In a particular embodiment of this use, the arrangement comes further equipped with a headset that comprises a noise filter for filtering out ambient sound. This enables the meditative practice of relaxing movements to fully focus on the movement by only hearing the respective sound feedback that generates from the arrangement of the present invention while masking distracting ambient sounds.

The bandwidth of applications of the arrangement of the present invention for sporting, medical, entertainment and relaxation purposes is very broad. Common to all applications of the arrangement of the present invention is that the enable real time accompaniments of a movement with a sound track that is reflective of the type, intensity and direction of the said movement. This provides an arrangement and uses of said arrangement that enable a user to reach a high level of emersion into an action and thus provides an entertainment device which is versatile in its fields of application.

It is evident for the skilled artisan, that any of the described particular embodiments can be realized in an arrangement or in the use of an arrangement according to the present invention in any combination as long as they are not mutually exclusive or explicitly stated as alternatives.

BRIEF DESCRIPTION OF SEVERAL VIEWS OF THE DRAWINGS

In the following, the present invention is further illustrated by means of a schematic drawing and specific examples, without being limited there to though.

The examples and drawing provide the skilled artisan with further advantages embodiments of the present invention.

The FIGURE is a schematic block diagram showing the functioning of an arrangement according to the present invention.

DETAILED DESCRIPTION OF THE INVENTION

The FIGURE shows schematically a block diagram representing two modes of function of an arrangement 10 according to the present invention. The arrangement 10 as shown in the FIGURE can be separated into a sensing unit 11 and in this case a plurality of output units 3. The sensing unit 11 comprises a sensor 1 or in the case of this specific example a sensor array 1 comprising a nine axes sensor each with three axis x, y, z for acceleration, rotation and magnetic field. Suitable sensors are available in the art, such as the BNO 055 from Bosch providing an absolute orientation sensor with integrated accelerometer, gyroscope and magneto meter for measuring linear motion and gravitational forces, the rate of rotation in space (roll, pitch, yaw) the terrestrial earth magnetic fields and coming equipped with all the required sensors for providing said information and processing it into digital readable force signal that can then be processed by the processing unit 2, which in this embodiment forms an integral part of the sensing unit 11. The processing unit then converts the force signal measured by the sensor 1 into a digital auditory signal, which is then transmitted by the Bluetooth module 15. In this particular example the Bluetooth model comes equipped with the required microprocessor for processing the force signal and thus the processing unit 2 and the Bluetooth module 15 can be both part of the same integrated module.

In the present example the transmission from the Bluetooth module 15 happens in the form of digital auditory signals in the MIDI format.

In a first mode of operation the output unit can be combined with this sensing unit such that the whole arrangement is made one piece. In the present example the output unit 3 can either be integrally formed with the sensing unit 11 or it can be a separate piece of equipment. In the second case, the output unit 3 would require a further Bluetooth module for receiving the digital auditory signal from the Bluetooth module 15 of the sensing unit 11. The output unit 3 comprises a sound creation module 16 and loud speaker 17.

Alternatively, or additionally the function of the output unit 3' can be performed by a smartphone. In this present example, the smartphone takes the form of the output unit 3'. Smartphones come equipped with a Bluetooth module 15' which is capable of receiving the digital auditory signal in a form of a MIDI signal from the Bluetooth module 15 of the sensing unit 11. Analogous to the functioning of the separate or integral output unit 3, the smartphone output unit 3' then processes the MIDI file with a sound creation module 16' which results in a sound output by means of loud speakers 17'. In addition to the functionality provides by the simplest embodiment of integrated or separate output unit 3, the smartphone output unit 3' can come equipped with configuration means 18 which provide means of choosing from a preselected range of sound types a particular modulation that can then be performed on the MIDI files by means of the sound creation module 16' which results in a different type of sound output by the loud speakers 17'.

This configuration module 18 can be controlled by means of a smartphone app, which provides the user with the increased functionality. By using the further smartphone resources, it becomes possible to provide different scopes of configuration for adapting the sound files. This can come in the form of digital downloads and/or preset and preconfigured sound patterns. Of course, the smartphone provides further functionalities, which are not shown in the block diagram but are integral in all modern smartphones, such as a visual representation by a screen, a memory storage and wireless or USB connectivity with the internet.

The app can further provide means of manipulating and modulating the sounds directly, while they are being generated such as to enable a further interactivity with a movement being processed by the arrangement 10 according to the present invention.

In a particular example, the loud speaker 17, 17' is further complemented by an audio jack which can be connected with adjacent loud speaker or further loud speakers.

In a particular example, where the arrangement is used in connection with an action camera, the audio outjack can be used to connect the arrangement 10 with an audio injack of the action camera, such as to provide the sound process by the arrangement 10 of the present invention directly onto the film file generated by the action camera.

In this specific example, the latency between actual movement that is registered as a force from the movement sensing unit up to the creation of the auditory signal at the loud speaker 17 is lower than 30 milliseconds. This enables a deep emersion into sound companioned movement. The Bluetooth transmission of the digital auditory signal has a maximal latency of 15 milliseconds, whereas the detection and processing of the force has a maximal latency of 15 milliseconds.

In a particular example, the algorithm running on the processor for converting the force signal into a digital auditory signal is capable of distinguishing between a sudden, abrupt movement and a continuous movement. In the case of a sudden, abrupt movement the latency is to be kept as low as possible, such as to convey the abruptness of the movement by means of the sound. It has surprisingly found though, that the latency is much less relevant in the conversion of continuous movement. A processor thus equipped to distinguish between sudden, abrupt movements can said respective priorities in the conversion of detected force signals into digital auditory signals that the sudden, abrupt movements are prioritized thereby not jeopardizing the emersion.

In the following, specific examples are presented for use and implementation of an arrangement according to the present invention.

EXAMPLE 1

Laser Sword

In this specific example, an arrangement according to the present invention is used for simulating a laser sword. A laser sword is a fictional and well-known popular media item that provides distinctive "swooshing" sound when handled. In this example an arrangement according to the present invention is used to simulate this sound with any item onto which the arrangement of the present invention can be detachably attached. The processor is adapted to in particular to detect movement of the fictions hilt of the sword, its position, swinging the sword, turning the fictions hilt and the impacting of two swords in its most basic application to broom sticks can be used by attaching to each a sensing element 10 according to the previously discussed setup. One or more output units 3, 3' can then be adapted to create the respective laser sword sound. In particular concerning swords, the sound can be subdivided into continuous fluid movements that comprise the swinging and turning of the hilt of the sword in contrast to impacting when two light sabers clash during a combat. The processor in this application is adapted to distinguish between the two types of movements and provide a particular priority to the once that require immediate sound effect such as the impact of the sword on an item. Commonly available sensors such as the sensor cited above are capable of distinguishing such movement and provide the required information for the processor to perform its prioritization.

It is a particular advantage of the arrangement according to the present invention, that two light sabers sound or even more can be processed simultaneously, such as to enhance the user experience and provide an emersion into a laser sword duo by measuring the movement of a plurality of sensors and providing a respective sound feedback.

This arrangement can come equipped with a specific software product and specific sound files adapted at providing the Doppler effect sounds that light sabers and laser swords are so well-known for.

EXAMPLE 2

Table Tennis Rackets

In this particular example, which is quite similar to the one with the laser swords above two sensing units are each attached or integrally formed with table tennis rackets. Alternatively, a Ping-Pong ball can be also equipped with a sensing unit, but considering that light weight is a specific requirement of Ping-Pong balls it might be more advisable to equip the rackets.

The processing unit is particularly adapted at sensing impact, impact strength, swing speed and direction and for/backhand hitting of the Ping-Pong ball. In a particular example, this sounds can take the form of an arcade like computer game. This makes Ping-Pong much more fun to watch and play.

A particular use of the arrangement of the present invention could be training purposes. A perfection of a particular hitting movement or a very sensitive detection of a movement within a certain boundary can be monitored by means of the motion detection and sensing of the arrangement according to the present invention. In this example, for instance a trespassing of a certain line with the table tennis racket can lead to a tilt sound with notifies the user or a coach of the event which enables accurate review of a movement.

EXAMPLE 3

Sound Painting

In this example one or more sensing units are used to detect a position relative to starting position, a speed of a movement and a turning of the sensing unit as well as a beating of the sensing unit to create a live sound corresponding to a particular movement pattern. A dancing and/or artistic movement can then directly be converted into a corresponding sound effect.

For sound painting in particular, machine learning can be applied to match a force signal or series of force signals to a pre-learned movement sequence and generate a specific digital auditory signal reflective of said movement sequence. The arrangement can come equipped with a multitude of pre-learned movement sequences, each representing a dancing move and each resulting in a specific auditory signal.

For this end, parameters can be generated by analyzing dance moves with an arrangement as described above. These parameters can result from indexing force signals from the various sensor means, such as, for instance, accelerometer, magnetometer, of such an arrangement, while a dancing move is performed repeatedly. These parameters, after being embedded in the arrangements' firmware can be matched with force signals resulting from dance moves and can result in a very low latency generation of sound effects upon detection and matching of that sound moves with a pre-learned movement sequence. For this end, machine learning algorithms can be used.

Further advantages implementation of an arrangement according to the present invention can easily derived by the skilled artisan from the dependent claims and the details description of this invention.

The invention claimed is:

1. An arrangement for the conversion of at least one detected force from the movement of a sensing unit into an auditory signal, comprising:

a) at least one sensor, for generating a force signal from the at least one detected force;

b) a processing unit, configured for converting the force signal into a digital auditory signal, wherein the digital auditory signal is a MIDI-signal;

c) an output unit, for converting the digital auditory signal into an auditory signal;

d) a first casing, the first casing housing the at least one sensor and the processing unit;

e) a second casing, the second casing housing the output unit; and f) a data exchange unit configured to wirelessly transfer the digital auditory signal between the processing unit and the output unit, wherein the digital auditory signal comprises information on acceleration, strength and duration of a single detected force; and wherein the processing unit is adapted to convert the force signal into a digital auditory signal with a latency lower than 20 ms, and wherein the processing unit is adapted to recognize a pre-learned movement sequence out of the force signal by applying a machine learning algorithm and converting the movement sequence into the digital auditory signal.

2. The arrangement according to claim 1, wherein the first casing and the second casing are arranged to be detachably combinable with each other, in a form fit.

3. The arrangement according to claim 1, wherein the first casing or the second casing have one or more fixing device for attaching the respective casing to one or more third device.

4. The arrangement according to claim 1, wherein the arrangement further comprises one or more rechargeable energy sources.

5. The arrangement according to claim 1, wherein the arrangement further comprises at least one communication system having a bus system and respective connections for data transfer.

6. The arrangement according to claim 1, wherein the processing unit is arranged to convert the force signal into a digital auditory signal by attributing a first digital information to a first force signal dimension, a second digital information to a second force signal dimension, a third digital information to a third force signal dimension, and in particular, by attributing a first digital information to an acceleration, a second digital information to an intensity and a third digital information to a duration of a single detected force.

7. The arrangement according to claim 1, wherein the output unit further comprises an audio output or an audio output connector.

8. The arrangement according to claim 1, wherein the arrangement comprises a storage medium for storing digital auditory signals.

9. The arrangement according to claim 1, wherein the processing unit is configured for converting a sequence of consecutively sensed force signals into a sequence of digital auditory signals according to a defined algorithm.

10. The arrangement according to claim 1, wherein the force sensor is adapted to sense acceleration in at least three axes.

11. The arrangement according to claim 1, comprising a plurality of sensors, for generating a force signal from a plurality of detected forces, each, and wherein the processor is configured to fuse the plurality of force signals into one digital auditory signal.

12. The arrangement according to of claim 11, wherein the processor generates a string of digital auditory signals out of the force signals processed per time interval.

13. The arrangement according to claim 1, wherein the at least one sensor is a sensor adapted at detecting a force affecting the arrangement, wherein the force is a movement or an impact affecting the arrangement, in particular wherein the at least one sensor is a sensor selected from the group consisting of: gyroscope, accelerometer and magnetometer.

14. The arrangement according to claim 1, wherein the processing unit is configured for converting the force signal into a digital auditory signal on the basis of a preselected determined conversion protocol.

15. The arrangement according to claim 1, wherein the processor is adapted to categorize the force signal and convert said force signal into a digital auditory signal based on a determined conversion protocol based on categorization.

16. A method of converting at least one detected force affecting an object into an auditory signal, comprising the steps of:

a) providing the arrangement for the conversion of at least one detected force into an auditory signal according to claim 1;

b) affixing the at least one sensor, including one or more force detection sensors, for generating a force signal from the at least one detected force and the processing unit, configured for converting the force signal into the digital auditory signal, both being integral parts of that arrangement, onto said object;

c) sensing a force affecting the object with the sensor and converting the force signal by recognizing a pre-learned movement sequence out of the force signal and by applying a machine learning algorithm into the digital auditory signal with the latency between detection and conversion of below 20 ms;

d) transferring the digital auditory signal between the processing unit and the output unit; and e) converting the digital auditory signal into the auditory signal by means of the output device.

17. The method according to claim 16, whereby an algorithm is provided that attributes each force signal to a corresponding digital auditory signal.

18. The arrangement according to claim 3, wherein the first casing and the second casing have one or more fixing device for attaching the respective casing to one or more third device.

19. The arrangement according to claim 7, wherein the output unit further comprises an audio output and an audio output connector.

20. The arrangement according to claim 13, wherein the at least one sensor is a sensor adapted at detecting a force affecting the arrangement, wherein the force is a movement and an impact affecting the arrangement, in particular wherein the at least one sensor is a sensor selected from the group consisting of: gyroscope, accelerometer and magnetometer.

* * * * *